US010631624B2

(12) United States Patent
Lenkiewicz et al.

(10) Patent No.: US 10,631,624 B2
(45) Date of Patent: Apr. 28, 2020

(54) CARPET AND UPHOLSTERY CLEANING PRODUCT

(71) Applicant: BISSELL Homecare, Inc., Grand Rapids, MI (US)

(72) Inventors: Kenneth M. Lenkiewicz, Grand Rapids, MI (US); Victoria J. Royale, Charlotte, MI (US); Lauren M. Lenkowski, Grandville, MI (US); Christopher D. Barr, Belmont, MI (US)

(73) Assignee: BISSELL Inc., Grand Rapids, MI (US)

( * ) Notice: Subject to any disclaimer, the term of this patent is extended or adjusted under 35 U.S.C. 154(b) by 178 days.

(21) Appl. No.: 15/419,270

(22) Filed: Jan. 30, 2017

(65) Prior Publication Data

US 2017/0215572 A1 Aug. 3, 2017

Related U.S. Application Data

(60) Provisional application No. 62/288,589, filed on Jan. 29, 2016.

(51) Int. Cl.

| | |
|---|---|
| ***A46B 11/00*** | (2006.01) |
| ***B05B 11/04*** | (2006.01) |
| ***A47L 13/26*** | (2006.01) |

(52) U.S. Cl.

CPC ..... *A46B 11/0062* (2013.01); *A46B 11/0041* (2013.01); *A47L 13/26* (2013.01); *B05B 11/043* (2013.01)

(58) Field of Classification Search

CPC ..... A46B 9/028; A46B 11/0041; A46B 2200/3033; B65D 2547/06; B65D 47/0842; B65D 1/023; B65D 1/0246; A47L 13/26

USPC ..... 401/137

See application file for complete search history.

(56) References Cited

U.S. PATENT DOCUMENTS

| | | | | |
|---|---|---|---|---|
| 2,828,500 | A * | 4/1958 | Peacock | A46B 11/0055 15/160 |
| 3,160,304 | A * | 12/1964 | Peacock | B05B 11/0005 215/399 |
| 3,184,781 | A | 5/1965 | Hoxie | |
| 4,533,273 | A | 8/1985 | Obata et al. | |
| 5,927,566 | A * | 7/1999 | Mueller | B65D 47/2031 222/490 |
| 7,258,747 | B2 * | 8/2007 | Vago | A46B 9/028 134/25.2 |

(Continued)

OTHER PUBLICATIONS https://www.bissell.com/spotstain-pet-carpetupholstery-cleaner-93521?source=igodigital, Bissell Spot & Stain Pet Carpet & Upholstery Cleaner Model No. 93521, 5 pages, Item accessed Jan. 19, 2016.

*Primary Examiner* — David P Angwin
*Assistant Examiner* — Bradley S Oliver
(74) *Attorney, Agent, or Firm* — McGarry Bair PC

(57) ABSTRACT

A carpet and upholstery cleaning product is configured to store a consumable cleaning solution and dispense the cleaning solution to treat a spot or stain on a surface to be cleaned. The cleaning product can include a bottle defining a reservoir for the cleaning solution, a fluid dispensing outlet provided on an angled neck of the, and a scrubber on the bottle for scrubbing stains on the surface to be cleaned, wherein the scrubber is offset from the fluid outlet such that the cleaning solution is not dispensed through the scrubber.

19 Claims, 7 Drawing Sheets

(56) References Cited

U.S. PATENT DOCUMENTS

| | | | | |
|---|---|---|---|---|
| 7,334,694 | B2 * | 2/2008 | Suffa | B65D 50/046 215/212 |
| 7,824,120 | B1 | 11/2010 | Kasper et al. | |
| 2009/0311029 | A1 * | 12/2009 | Guttmann | A47K 7/028 401/139 |

* cited by examiner

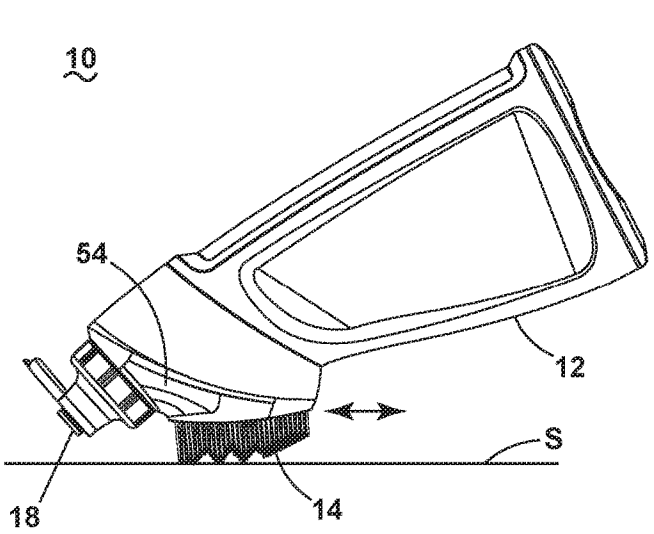
FIG. 5C
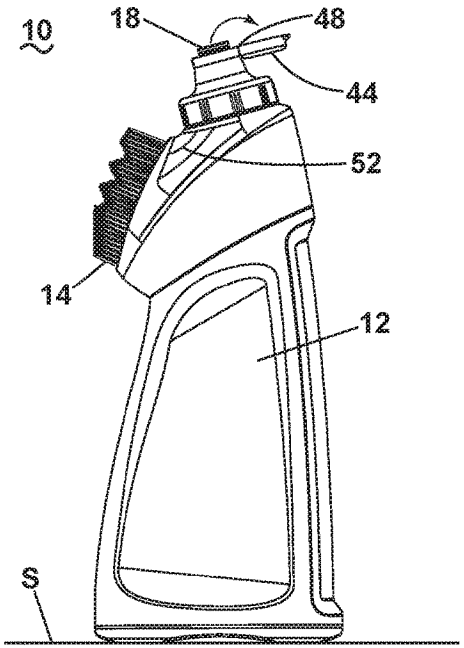
FIG. 5B
FIG. 5A

CARPET AND UPHOLSTERY CLEANING PRODUCT

CROSS-REFERENCE TO RELATED APPLICATION(S)

This application claims the benefit of U.S. Provisional Patent Application No. 62/288,589, filed Jan. 29, 2016, which is incorporated herein by reference in its entirety.

BACKGROUND

Soft surfaces, such as carpets, rugs, and upholstery, can become soiled by debris or other materials during use. In some instances, it may be desirable to apply a cleaning solution to a spot or stain to facilitate removal of debris and soiling material from the surface. Consumable cleaning products are provided for storing and dispensing a cleaning solution to treat a surface to be cleaned. Such cleaning products include different types of applicators for applying cleaning solution; some examples are trigger spray bottles which depend on a trigger lever to activate a pump, aerosol containers which depend on a pressurized discharge of cleaning solution, or squeeze bottles which depend upon force applied to the bottle itself to dispense cleaning solution.

BRIEF SUMMARY

In one aspect, the invention relates to a consumable carpet and upholstery cleaning product configured to store a cleaning solution and dispense the cleaning solution to treat a surface to be cleaned. The cleaning product can include a bottle configured to contain a cleaning solution, a fluid outlet provided on an angled neck of the bottle for selectively dispensing the cleaning solution to the surface to be cleaned, and a scrubber on the bottle for scrubbing stains on the surface to be cleaned, wherein the scrubber is offset from the fluid outlet such that the cleaning solution is not dispensed through the scrubber.

BRIEF DESCRIPTION OF THE DRAWINGS

In the drawings:

FIG. 5A-C illustrate the use of the cleaning product shown in FIG. 1 to clean a surface;

DESCRIPTION OF EMBODIMENTS OF THE INVENTION

The invention generally relates to a carpet and upholstery cleaning product. The cleaning product can be used to dispense a cleaning solution to treat spots and stains on carpet, upholstery, and other soft surfaces such as rugs.

The cleaning product can comprise one or more of the following: (a) an ergonomic configuration of an angled bottle neck and a bristle block offset from a longitudinal bottle axis; (b) a fluid distribution spout that is visible and oriented towards the "front" of the product when the bottle is in the in-use position; (c) a bottle that contains a peroxygen cleaning solution; and/or (d) a squeezable bottle configured to distribute a larger volume of cleaning solution compared to a conventional trigger spray bottle, which enhances cleaning performance and improves user satisfaction.

Figure 1:
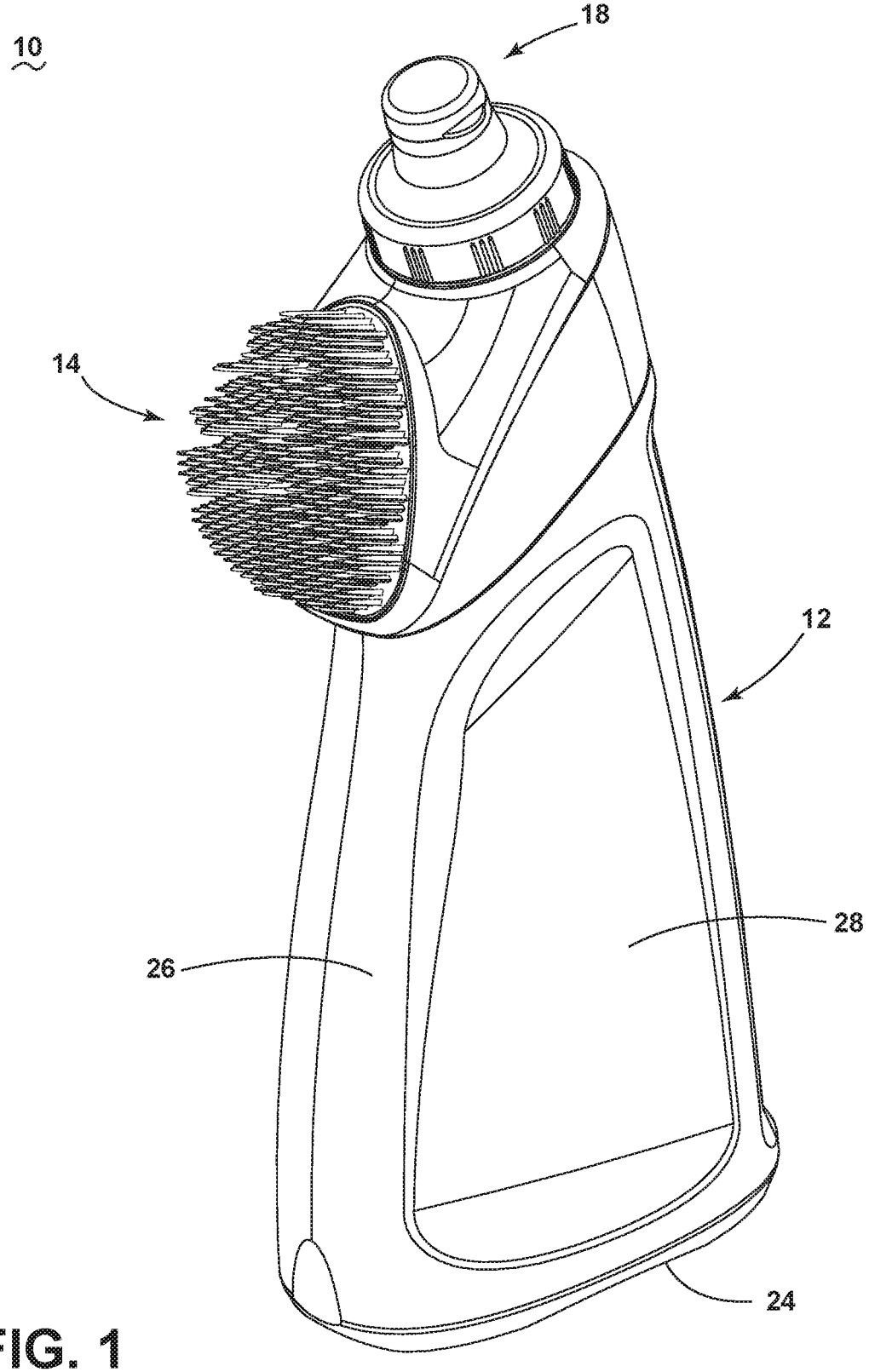
FIG. 1 is a perspective view of a cleaning product according to one embodiment of the invention.
Figure 6:
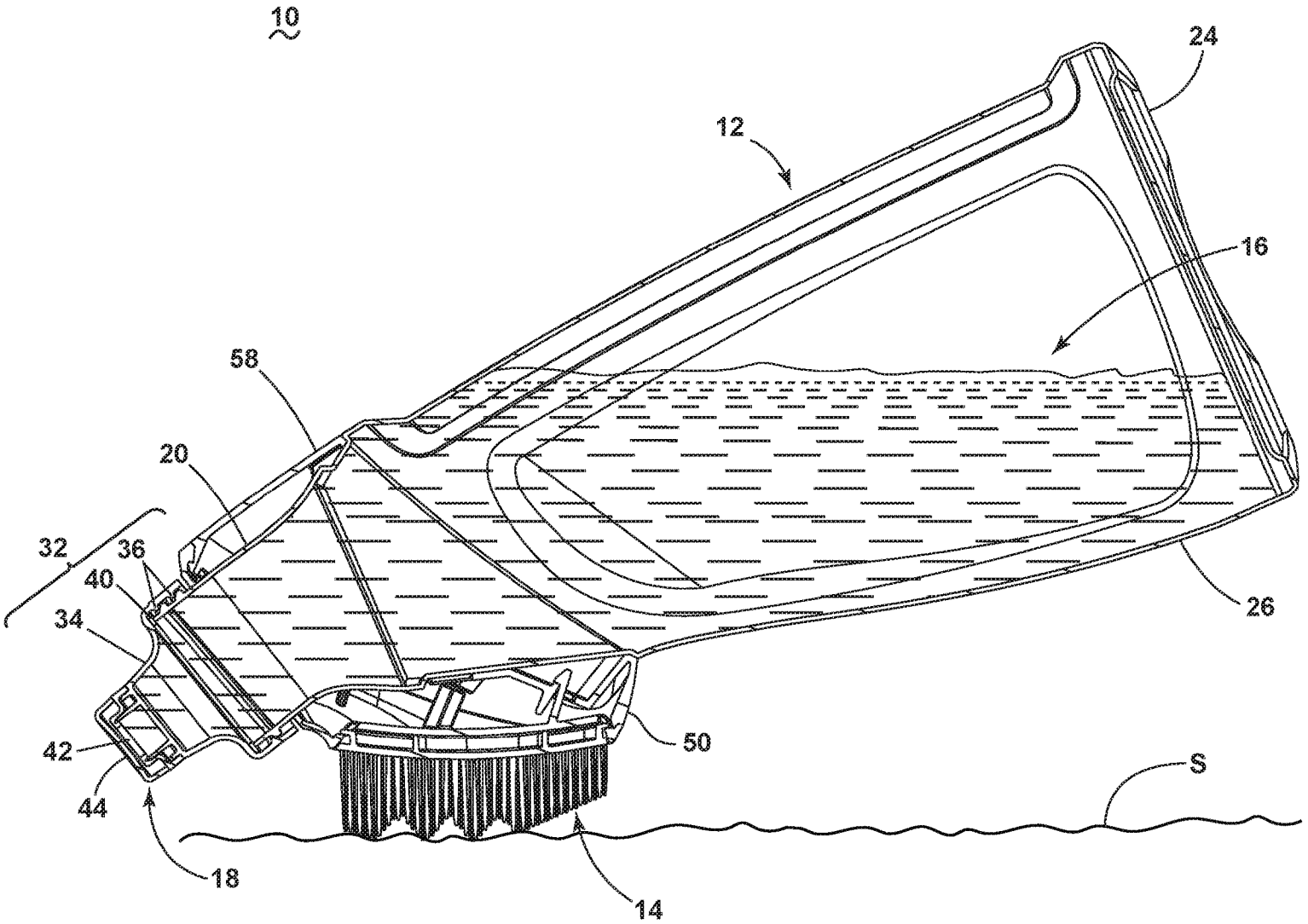
FIG. 6 is a cross-sectional view of the cleaning product of FIG. 1 in a use position.

FIG. 1 is a perspective view of a cleaning product 10 according to one embodiment of the invention. The cleaning product 10 is a manually-applied, consumable cleaning product comprising a squeezable plastic bottle 12 packaged with an agitator or scrubber 14 and containing a cleaning formula or solution 16 (FIG. 6). The bottle 12 includes a fluid outlet 18 for selectively dispensing the cleaning solution 16, with the scrubber 14 generally adjacent the fluid outlet 18 on the same general end of the bottle 12 for scrubbing stains on the surface to be cleaned.

As used herein with reference to the bottle 12, the term squeeze, and variations thereof, is used to mean compressing the bottle 12 with one hand by a person using the cleaning product 10. Squeezing the bottle 12 increases the pressure inside the bottle 12, which forces the cleaning solution 16 through the fluid outlet 18. The bottle can be adapted to held and squeezed by one hand of the user, including being sized to be held by one hand of a person, being formed from materials which may be squeezed, such as plastic, and being substantially hollow. Some examples of some suitable materials for the bottle include, but are not limited to thermoplastic polymers, such as high-density polyethylene (HDPE).

The cleaning solution 16 can include one or more components, non-limiting examples of which include water, detergents, surfactants, solvents, fragrances, stain resist agents, anti-soiling agents, bleaches, peroxides and peroxygen containing compounds, anti-odor agents, stain removal agents, and combinations thereof. In one example, the cleaning solution 16 can be liquid peroxygen cleaning formula containing hydrogen peroxide, and optionally one or more of surfactants, anti-resoil compounts, and water. One suitable peroxygen cleaning solution is more fully described in U.S. Patent Application Publication No. 2009/0236363, published Sep. 24, 2009 and incorporated herein in its entirety.

Figure 2:
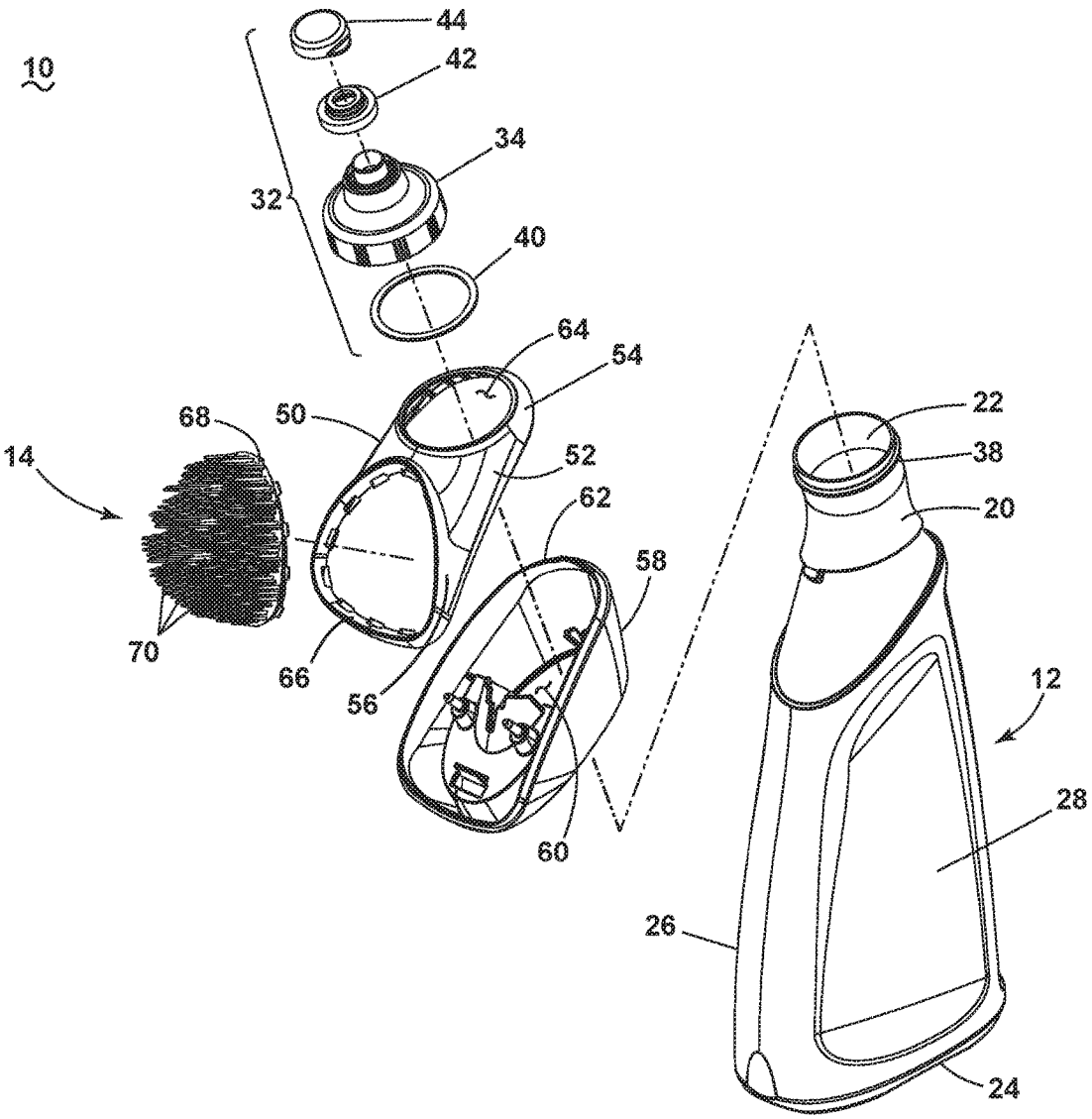
FIG. 2 is an exploded view of the cleaning product shown in FIG. 1.

With additional reference to FIG. 2, which is an exploded view of the cleaning product 10 shown in FIG. 1, the squeezable bottle 12 has an angled neck 20 defining an opening 22 through which cleaning solution 16 can be filled and/or dispensed. The illustrated bottle 12 further has a bottom wall 24 and a peripheral side wall 26 extending upwardly from the bottom wall 24 and converging with the neck 20. The side wall 26 is configured to be gripped by a user and squeezed to dispense the cleaning solution 16 through the fluid outlet 18. Indentations 28 can be molded into the side wall 26, and can form grips configured to facilitate a secure hold on the bottle 12 when squeezing.

A dispenser defining the fluid outlet 18 can be provided in the form of a cap assembly 32 and is received on the angled neck 20. In one example, the cap assembly 32 can be threaded onto the neck 20. The cap assembly 32 includes a cap 34, which may have internal threads 36 (FIG. 6) for receiving external threads 38 on the neck 20, an annular seal 40 between the bottom of the cap 34 and the top of the neck 20, a valve 42 and a closure 44. The cap 34 is hollow to define a portion of a dispensing path for the product 10 therethrough, and the valve 42 is configured to open and close the dispensing path through the fluid outlet 18. The valve 42 can be a pressure-controlled directional valve that opens the fluid outlet 18 upon the user squeezing the bottle 12 to allow cleaning solution 16 to be dispensed. Squeezing the bottle 12 increases the pressure inside the bottle 12, which in turn opens the directional valve 42.

The closure 44 can be a flip-top cover that is hinged to or otherwise joined with the cap 34, and covers the valve 42 and the top of the cap 34. In one non-limiting example, the flip-top cover can be joined with the cap 34 by a living hinge 48 (FIG. 5A).

The scrubber 14 can be provided on a scrubber base 50 on the bottle 12. The scrubber base 50 can define an angled or curved upper surface 52 on which the scrubber 14 and the dispenser 32 are both provided. As shown herein, the surface 52 can be angled to define two different sections or planes, with the scrubber 14 provided on a first section or plane 54 of the surface 52 and the fluid outlet 18/dispenser 32 provided on a second section or plane 56 of the surface 52. The sections/planes 54, 56 may be flat or have a curvature. Alternatively, the surface 52 can be more smoothly curved, without the distinct sections shown in the illustrated embodiment.

A bottle skirt 58 projects outwardly around the neck 20 and can support the scrubber base 50. The bottle skirt 58 includes an aperture 60 for the neck 20 to pass therethrough, and an upper edge 62 that seats the scrubber base 50. The scrubber base 50 also includes an aperture 64 for the neck 20 that is aligned with the aperture 60 in the bottle skirt 58, as well as a mount 66 for affixing the scrubber 14.

Figure 8:
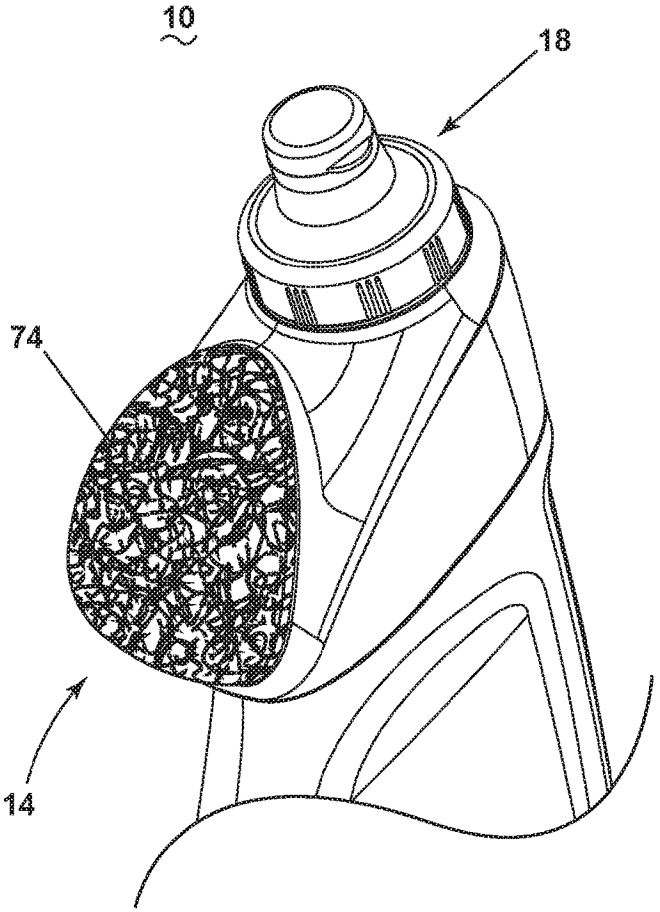
FIG. 8 is a perspective view of a cleaning product according to a third embodiment of the invention.
Figure 7:
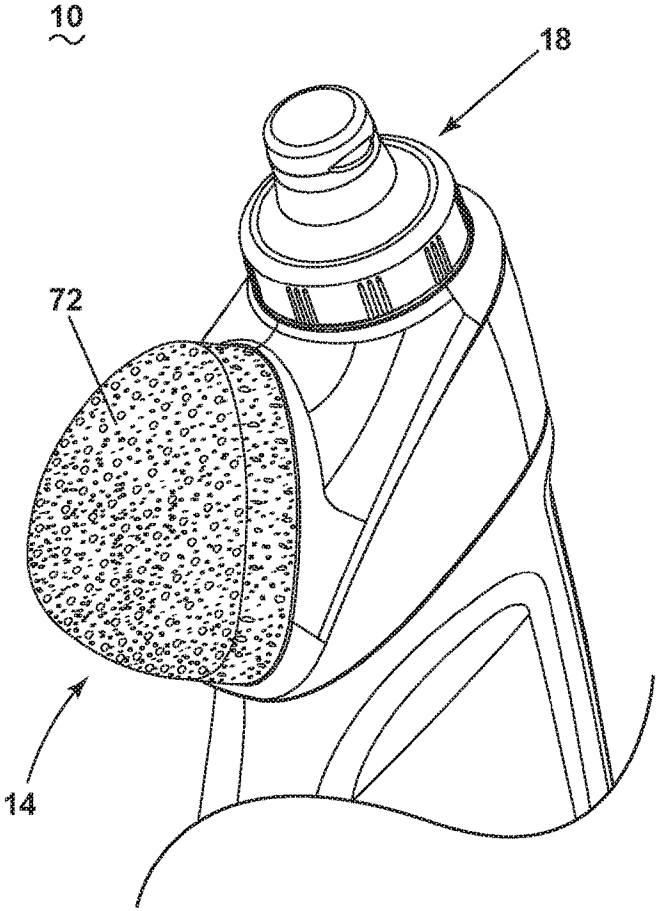
FIG. 7 is a perspective view of a cleaning product according to a second embodiment of the invention.

The scrubber 14 can be a bristle block 68 having a plurality of bristles 70. The bristles 70 can be made from plastic, and can be integrally molded with the bristle block 68 or can comprise tufts of individual bristles 70 attached to the bristle block 68. The bristles 70 can be arranged in rows having a chevron pattern. The bristles 70 extend from the bristle block 68 to free terminal ends. The bristles 70 can comprise varying lengths such that successive rows of bristles alternate between taller and shorter heights for the terminal ends, arranged in a saw tooth pattern, for example. One examples of a suitable material for the bristles 70 include, but is not limited to, low-density polyethylene (LDPE). Other embodiments of the scrubber 14 are also possible, such as a foam block 72, as shown in FIG. 7, or nonwoven pad 74, as shown in FIG. 8, for example.

Figure 3:
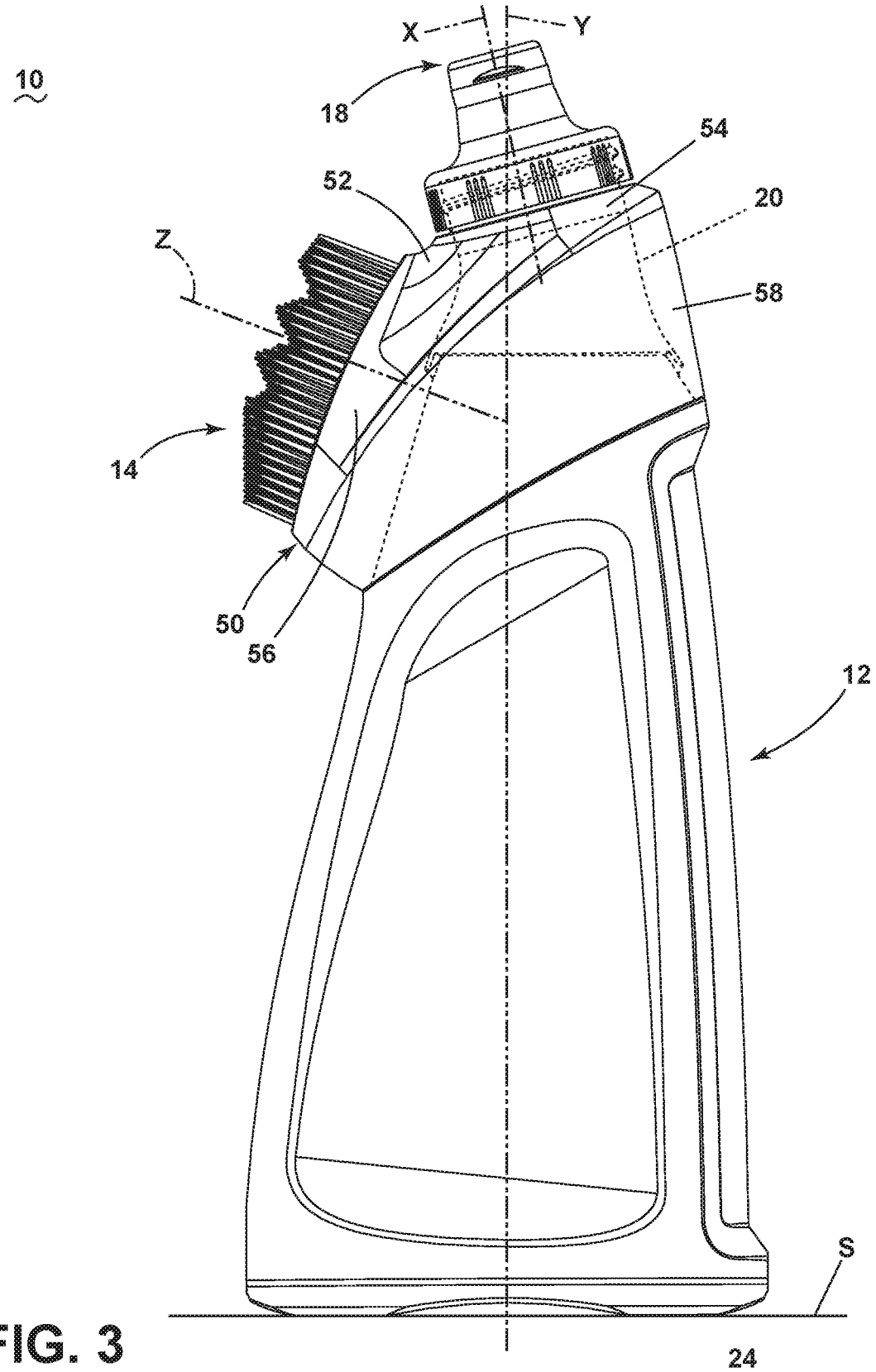
FIG. 3 is a side view of the cleaning product of FIG. 1.

FIG. 3 is a side view of the cleaning product 10 of FIG. 1. The bottle 12 can have an ergonomic bottle design, which has been configured to improve comfort, ease of use and performance. The neck 20 of the bottle 12 is angled so a fluid outlet axis X defined by the fluid outlet 18 diverges from a longitudinal bottle axis Y defined as an axis extending through the bottle 12 perpendicular to a surface S on which the bottom wall 24 can rest. This configuration makes it easier for a user to aim the fluid outlet 18 downwardly at stains when the bottle 12 is tipped horizontally/downwardly to a use position, one example of which is shown in FIG. 6. The fluid outlet axis X can be defined through the fluid outlet 18, and more particularly as a central axis through the fluid outlet 18 that is perpendicular to the opening through which cleaning solution 16 is dispensed, which is the outlet opening of the valve 42 in the illustrated embodiment. The fluid outlet axis X may further be substantially parallel to the stream of cleaning solution 16 dispensed out of the fluid outlet 18, although it is understood that in some embodiments, a portion of the stream of cleaning solution 16 may diverge from the axis X.

The scrubber 14 is oriented along a scrubber axis Z that lies at an angle that diverges from the bottle axis Y as well. The scrubber 14 is positioned rearwardly, relative to the position of the user holding the cleaning product 10, one example of which is shown in FIG. 6, of the fluid outlet 18 when the bottle 12 is tipped to the use position so that the fluid outlet 18 and the stream of cleaning solution 16 emitted from the fluid outlet 18 is unobstructed and visible towards the front of the cleaning product 10, which makes is easier for a user to target and treat stains.

The fluid outlet axis X and scrubber axis Z are divergent as well, so that a user can dispense cleaning solution 16 from the fluid outlet 18 without obstruction by the scrubber 14 and so that a user can scrub using the scrubber 14 without obstruction by the fluid outlet 18. Dispensing and scrubbing can be carried out in discrete operations, rather than, for example, dispensing through a scrubber itself. Dispensing through a scrubber can be problematic, since a user cannot see the area being treated or how much cleaning fluid is being dispensed.

Additionally, the configuration of the squeezable bottle 12, including the downward angled neck 20 and fluid outlet 18 in the in-use position offers improved cleaning performance when compared to conventional spray bottles. Testing has shown that the bottle configuration of the cleaning product 10 causes users to apply a larger volume of cleaning solution onto a stain compared to a conventional spray bottle with a trigger actuator. Applying more cleaning solution generally enhances cleaning performance and improves user satisfaction. In one test, a group of users applied an average of approximately 28 grams of cleaning solution when using a spray bottle with a trigger actuator, whereas the same group of users applied average of approximately 50 grams using the cleaning product 10—a nearly 78% increase, resulting in better cleanability scores, which can be based on a comparison of colorimetric measurements on the carpet backing and carpet fibers.

Figure 4C:
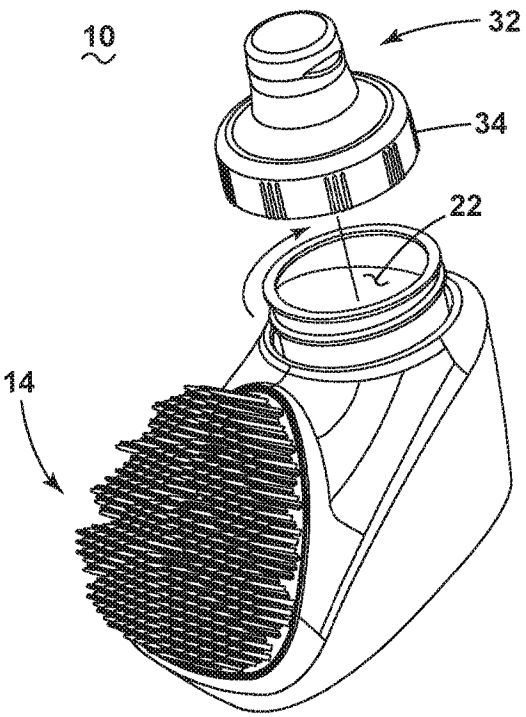
FIG. 4A-C illustrate the opening of a seal for the cleaning product shown in FIG. 1.
Figure 4B:
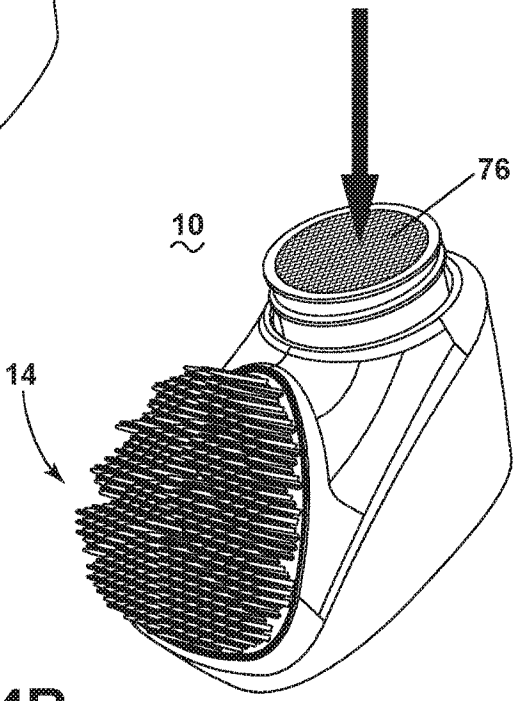
Figure 4A:
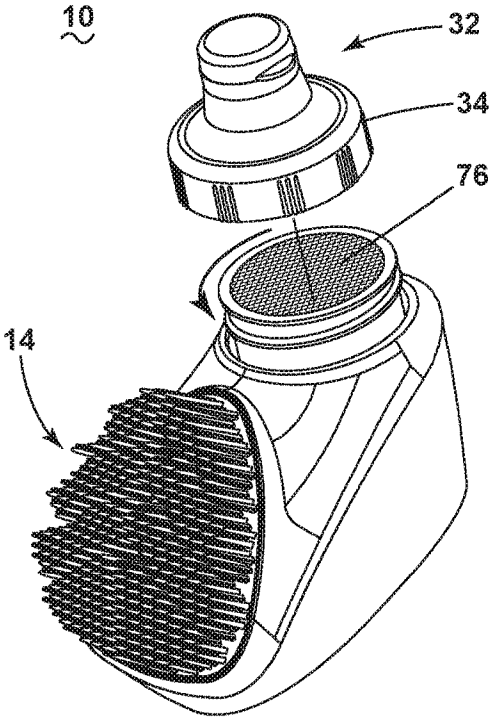

FIG. 4A-4C illustrate the opening of a seal for the cleaning product 10. The cleaning product 10 can optionally be sealed during shipping and handling, and a user may open the seal after purchasing the cleaning product 10. In one example, a foil seal 76 can be provided under the cap 34 and covers the opening 22 of the bottle 12. To unseal the cleaning product 10, the user can remove the cap 34 from the bottle 12 as shown in FIG. 4A, and then break the foil seal as shown in FIG. 4B. The cap 34 can then be reattached as shown in FIG. 4C, with the cleaning product 10 now ready for dispensing.

FIG. 5A-C illustrate the use of the cleaning product 10 to clean a surface S. In operation, the user flips open the top closure 44 as shown in FIG. 5A and inverts the bottle 12 to dispense the cleaning solution 16 onto the surface S to be cleaned by squeezing the bottle 12 to apply a predetermined amount of pressure to emit a stream of cleaning solution 16 as shown in FIG. 5B. In one example, the predetermined amount of pressure that will open the valve 42 is approximately 1 psi. The top closure 44 is forward of and above the fluid outlet 18 in the use position shown in FIG. 5B, so that it will not obstruct the stream of cleaning solution 16. The user then scrubs the treated surface S with the scrubber 14 as shown in FIG. 5C. During scrubbing, the top closure 44 can remain open, or be closed; the valve 42 will remain closed in either case as long as the predetermined amount of pressure is not applied to the bottle 12. Because the fluid outlet 18 and scrubber 14 are provided on the angled or rounded surface 52, the user need not change holding positions between dispensing and scrubbing, and need only rotate the bottle 12 slightly downwardly to begin scrubbing after dispensing.

There are several advantages of the present disclosure arising from the various features of the apparatuses described herein. For example, the embodiments of the invention described above provides a more ergonomic package than prior cleaning products because the bottle neck is angled to point downwardly in the use position. Another advantage of the present disclosure is that the disclosed configuration makes it easier for a user to target and apply cleaning solution to spots and stains because the fluid outlet is visible, unlike some prior cleaning products which position the fluid outlet within a scrubber or agitator and do not have visible fluid outlets. Yet another advantage of the present disclosure is that the squeeze bottle can contain a peroxygen cleaning solution.

Yet another advantage is that many conventional cleaning products require the user to blot the treated area with a separate cloth after application of the cleaning solution. This creates a scenario where the user may come into direct skin contact with the cleaning solution. The cleaning product provided herein provides an integrated scrubber so that the user can avoid contact with the dispensed formula.

Yet another advantage of the present disclosure is that the bottle is squeezable and will distribute a larger volume of cleaning solution compared to a conventional trigger spray bottle, which enhances cleaning performance and improves user satisfaction.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A consumable carpet and upholstery cleaning product configured to store a cleaning solution and dispense the cleaning solution to treat a surface to be cleaned, the consumable carpet and upholstery cleaning product comprising:

- a bottle configured to contain a cleaning solution and comprising:
  - a bottom wall on which the bottle can rest;
  - a neck defining a bottle opening; and
  - a longitudinal bottle axis defined as an axis extending through the bottle perpendicular to a surface on which the bottom wall of the bottle can rest;
- a fluid outlet provided on the neck and parallel therewith for selectively dispensing the cleaning solution to the surface to be cleaned;
- a base, comprising:
  - a bottle skirt having a first body with a first aperture through which the neck passes there through and an upper edge;
  - a base body having an upper edge and a lower edge, spaced from the upper edge, the lower edge configured to be seated on the upper edge of the bottle skirt, the base body further comprises a second aperture through which the neck passes;
- a scrubber provided on the upper edge of the base body, the scrubber oriented along a scrubber axis that lies at an angle that diverges from the longitudinal bottle axis, the scrubber configured for scrubbing stains on the surface to be cleaned.

2. The consumable carpet and upholstery cleaning product of claim 1 wherein the scrubber is offset from the longitudinal bottle axis such that the longitudinal bottle axis does not intersect the scrubber.

3. The consumable carpet and upholstery cleaning product of claim 1, further comprising a dispenser cap assembly defining the fluid outlet, wherein the dispenser cap assembly is received on the neck and covers the bottle opening.

4. The consumable carpet and upholstery cleaning product of claim 3, wherein the dispenser cap assembly comprises a valve operable to selectively open a dispensing path through the fluid outlet.

5. The consumable carpet and upholstery cleaning product of claim 4, wherein the valve comprises a pressure-controlled directional valve that opens the fluid outlet upon squeezing of the bottle to dispense the cleaning solution.

6. The consumable carpet and upholstery cleaning product of claim 4, wherein the dispenser cap assembly further comprises a cap covering the bottle opening and a closure movably coupled with the cap and selectively covering the valve.

7. The consumable carpet and upholstery cleaning product of claim 6, wherein the closure comprises a flip-top cover that is hinged to or otherwise joined with the cap.

8. The consumable carpet and upholstery cleaning product of claim 1 wherein the scrubber comprises a foam block, nonwoven pad, or bristle block having a plurality of bristles.

9. The consumable carpet and upholstery cleaning product of claim 8, wherein the bristle block is rearward of the fluid outlet, relative to the position of a user holding the bottle in a use position in which the fluid outlet is pointed downwardly toward the surface to be cleaned.

10. The consumable carpet and upholstery cleaning product of claim 8, wherein the bristle block is spaced from the fluid outlet.

11. The consumable carpet and upholstery cleaning product of claim 8, wherein the bristles have terminal ends and comprise varying lengths such that the bristles are arranged in a saw tooth pattern.

12. The consumable carpet and upholstery cleaning product of claim 1 wherein an uppermost surface of the base is one of angled or curved.

13. The consumable carpet and upholstery cleaning product of claim 12 wherein angled uppermost surface defines two different sections or planes.

14. The consumable carpet and upholstery cleaning product of claim 13 wherein at least one of the two different sections has a curvature.

15. A consumable carpet and upholstery cleaning product configured to store a cleaning solution and dispense the cleaning solution to treat a surface to be cleaned, the consumable carpet and upholstery cleaning product comprising:

- a bottle configured to contain a cleaning solution and comprising:
  - a bottom wall on which the bottle can rest;
  - a neck defining a bottle opening; and
  - a longitudinal bottle axis defined as an axis extending through the bottle perpendicular to a surface on which the bottom wall of the bottle can rest;
- a dispenser defining a fluid outlet provided on the neck for selectively dispensing the cleaning solution to the surface to be cleaned, wherein the neck of the bottle is angled relative to the longitudinal bottle axis so that a fluid outlet axis extending through the fluid outlet is non-parallel to the longitudinal bottle axis and the fluid outlet axis is parallel with the neck of the bottle;

a base, comprising:

a bottle skirt having a first body with a first aperture through which the neck passes there through and an upper edge;

a base body having an upper edge and a lower edge, spaced from the upper edge, the lower edge configured to be seated on the upper edge of the bottle skirt, the base body further comprises a second aperture through which the neck passes; and a scrubber provided on the upper edge of the base body, the scrubber configured for scrubbing stains on the surface to be cleaned and wherein the scrubber is offset from the fluid outlet such that the fluid outlet axis does not intersect the scrubber.

16. The consumable carpet and upholstery cleaning product of claim 15, further comprising the cleaning solution, wherein the cleaning solution is provided within the bottle.

17. The consumable carpet and upholstery cleaning product of claim 16, wherein the cleaning solution comprises a liquid peroxygen cleaning formula.

18. The consumable carpet and upholstery cleaning product of claim 15 wherein the bottle comprises a squeezable plastic bottle having a peripheral side wall extending upwardly from the bottom wall and converging with the neck, wherein the side wall is configured to be gripped by a user and squeezed to dispense the cleaning solution through the fluid outlet.

19. The consumable carpet and upholstery cleaning product of claim 15 wherein the scrubber comprises bristles that extend along a scrubber axis that is non-parallel to the longitudinal bottle axis.

* * * * *